United States Patent [19]

Hoover

[11] Patent Number: 4,523,424

[45] Date of Patent: Jun. 18, 1985

[54] UNIVERSAL RING TRAVELER

[76] Inventor: Donald R. Hoover, Rte. 3, Ratchford Rd., Gastonia, N.C. 28052

[21] Appl. No.: 598,198

[22] Filed: Apr. 9, 1984

[51] Int. Cl.[3] ..... D01H 7/60

[52] U.S. Cl. ..... 57/125; 57/119

[58] Field of Search ..... 57/119, 125

[56] References Cited

U.S. PATENT DOCUMENTS

| | | | |
|---|---|---|---|
| 651,650 | 6/1900 | McMichael | 57/125 |
| 1,464,674 | 8/1923 | Gilligan | 57/125 |
| 1,495,636 | 5/1924 | Feaster | 57/125 X |
| 1,834,874 | 12/1931 | Schaaff | 57/125 X |
| 2,127,082 | 8/1938 | Delagrange | 57/125 |
| 3,300,963 | 1/1967 | Wayson | 57/125 X |
| 3,482,388 | 12/1969 | Chilpan | 57/125 |

FOREIGN PATENT DOCUMENTS

| | | | |
|---|---|---|---|
| 832074 | 4/1960 | United Kingdom | 57/125 |

*Primary Examiner*—Donald Watkins
*Attorney, Agent, or Firm*—Clifton Ted Hunt

[57] ABSTRACT

A universal traveler is provided for ring spinning machines, the traveler being structured to permit repositioning of the traveler on the ring after a portion of the traveler has been worn.

3 Claims, 18 Drawing Figures

FIG. 1
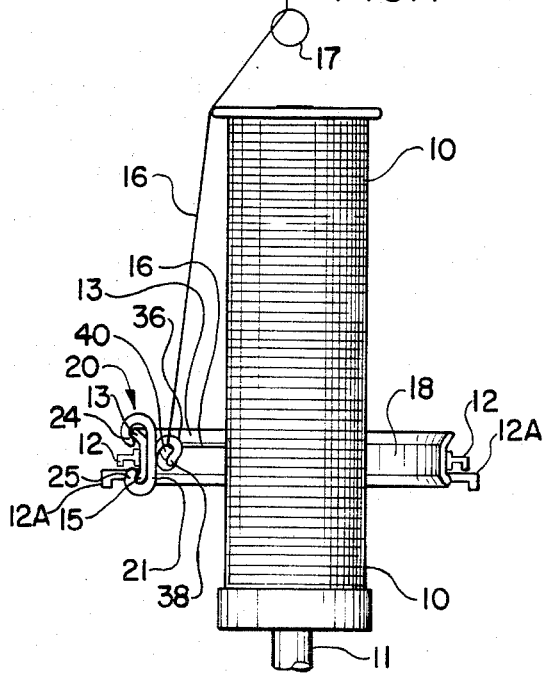
FIG. 2
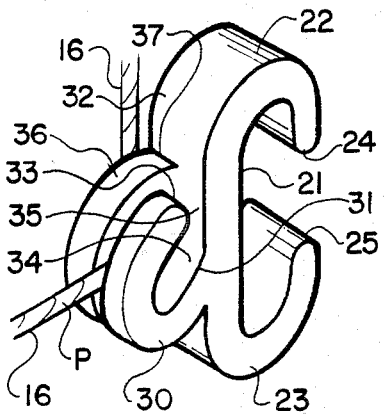
FIG. 3
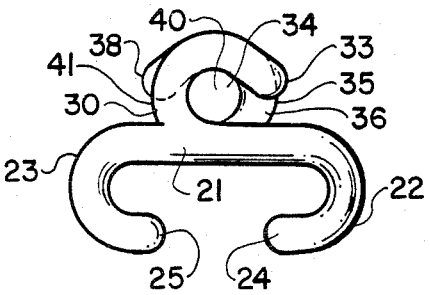
FIG. 4
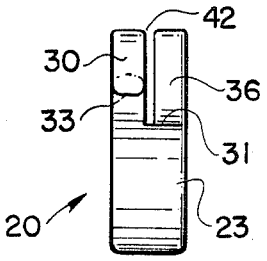
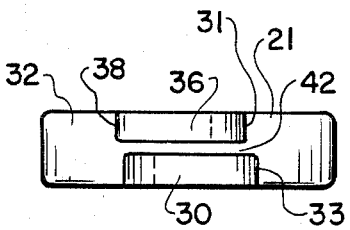
FIG. 5
FIG. 1A
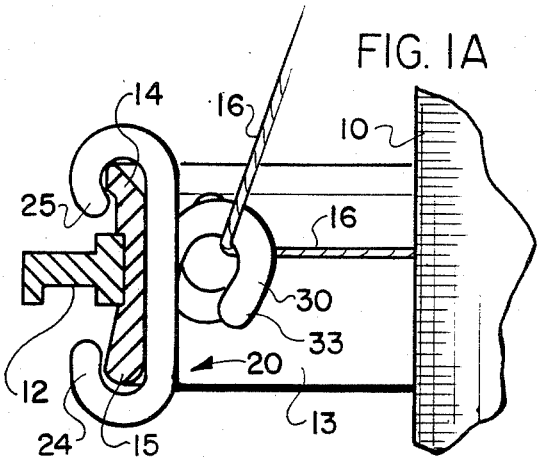

FIG. 6
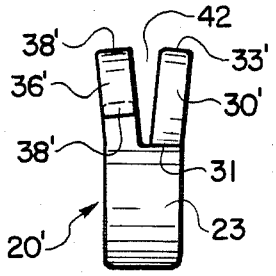
FIG. 7
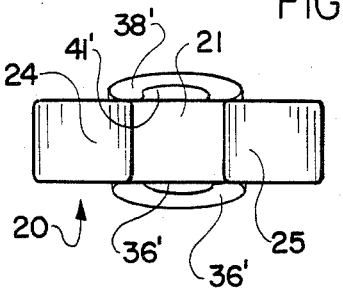
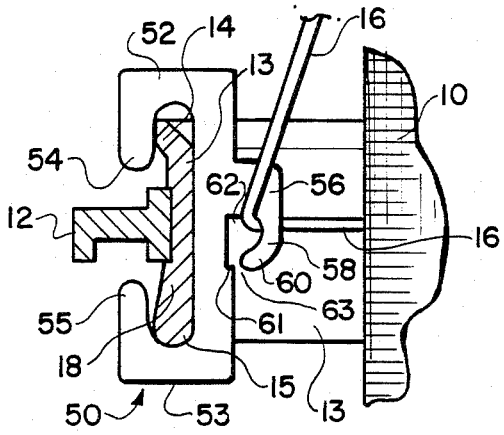
FIG. 10
FIG. 8
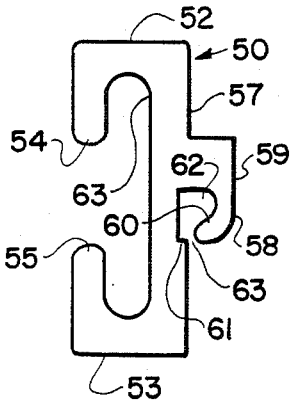
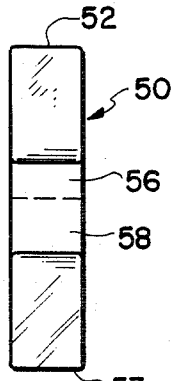
FIG. 9
FIG. 11
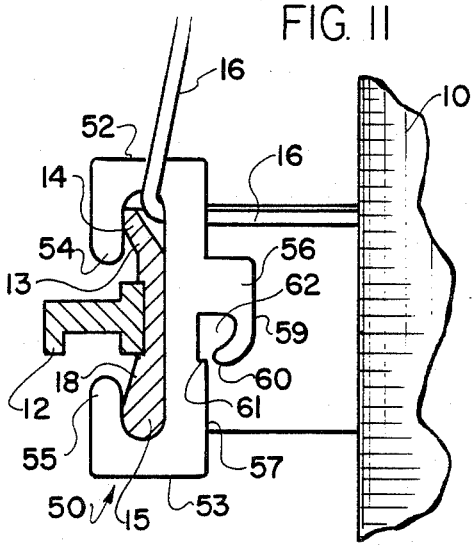

FIG. 12
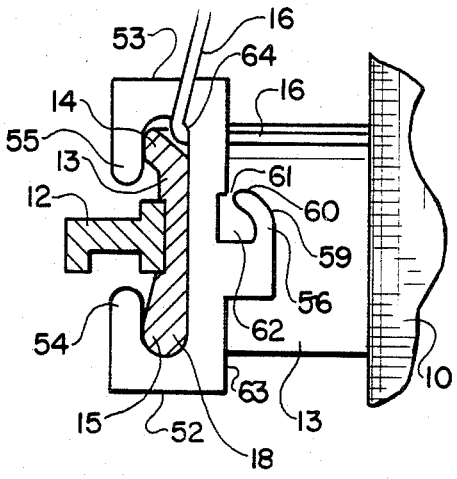
FIG. 15
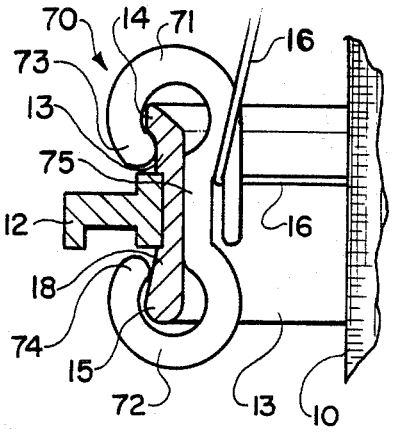
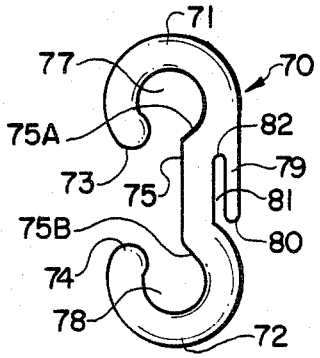
FIG. 13
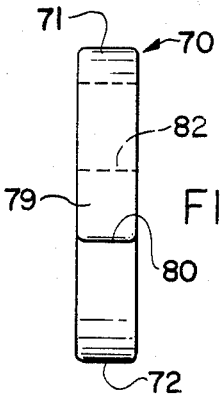
FIG. 14
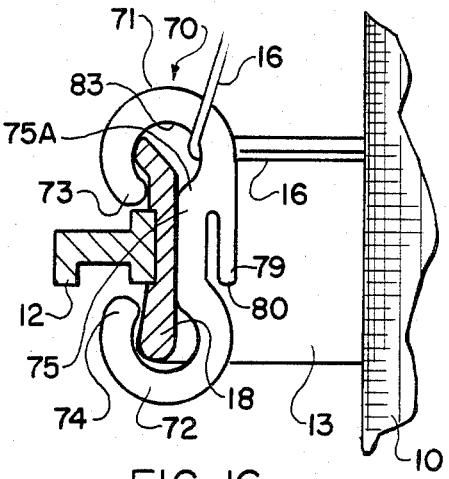
FIG. 16
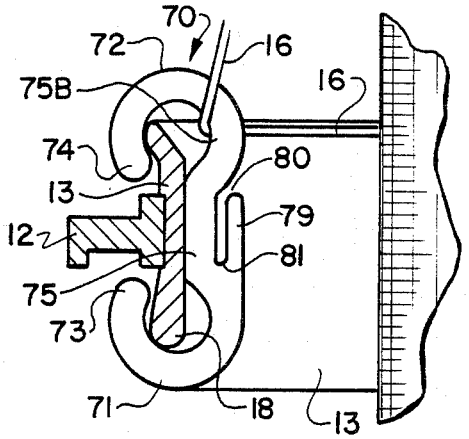
FIG. 17

UNIVERSAL RING TRAVELER

BACKGROUND OF THE INVENTION

Ring travelers are used in the winding of yarn on a bobbin. A spindle carrying the bobbin revolves at a high speed and carries an end of yarn with it. A traveler is mounted on the circular track of a stationary ring surrounding the bobbin. The yarn is threaded through the traveler and causes it to revolve at high speed on the circular track of the ring. The friction generated by the high speed of the traveler causes the traveler to deteriorate and become inoperative and require replacement after a period of use.

The prior art contains many attempts to reduce friction and prolong the life of the traveler. See, for example, the following U.S. Pat. Nos.:

588,817: George O. Draper, Aug. 24, 1897
2,198,636: Louis W. Schoaff, Apr. 30, 1940
2,320,213: Maurice L. Bolton, May 25, 1943
2,756,558: William M. Camp et al., July 31, 1956
3,368,342: Johann Kaiser, Feb. 13, 1968
3,373,557: Chester L. Loveland, Mar. 19, 1968
3,995,419: Robert L. Goerens, Dec. 7, 1976

Many of these structures have enjoyed a measure of success, but friction and wear are inherent in the function of the traveler and there remains room for improvement in the field.

SUMMARY OF THE INVENTION

It is an object of this invention to provide a ring traveler so constructed that it will slide around the ring with minimal friction and which can be reused by repositioning the yarn at a different position on the traveler.

It is a more specific object of the invention to provide a ring traveler having the usual shank and upper and lower hooks extending about respective upper and lower flanges of a vertically reciprocable ring, and said traveler including at least one yarn passageway projecting from the surface of the shank opposite the hooks. The yarn passageway is located midway between the free ends of the hooks of the traveler so that a yarn extending through the yarn passageway equalizes the pressure of the hooks against the ring as the traveler traverse the ring.

There are two yarn passageways on the back of the traveler in one embodiment of the invention, it being intended for the yarn to be positioned in a second passageway after the first one has become undesirably worn. Convenient access to the yarn passageway on the back of the traveler is provided in each embodiment of the present invention without having to remove the traveler from the ring and without having to thread the end of the yarn through the passageway.

BRIEF DESCRIPTION OF THE DRAWINGS

FIG. 1 is a fragmentary side elevation, partially in section and with parts broken away, of a bobbin, ring rail, ring and traveler, illustrating the environment of the present invention;

FIG. 1A is a fragmentary view similar to FIG. 1 showing the same traveler repositioned on the ring and with the yarn passing through a second position on the traveler;

FIG. 2 is a perspective view looking at the top, back and one side of one embodiment of the invention;

FIG. 3 is a side view of the traveler shown in FIG. 2;

FIG. 4 is an end view of the traveler shown in FIG. 2;

FIG. 5 is a rear view of the traveler shown in FIG. 2;

FIG. 6 is an end view similar to FIG. 4 but illustrating a modified form of the invention;

FIG. 7 is a front view of the traveler shown in FIG. 6;

FIG. 8 is a side view of a third embodiment of the invention;

FIG. 9 is a rear view of the traveler shown in FIG. 8;

FIG. 10 is an environmental view similar to FIG. 1, but illustrating the traveler of FIG. 8 with yarn passing through a first position on the traveler;

FIG. 11 is a view similar to FIG. 10 showing the same traveler continuing in use after the first position has become undesirably worn, and with the yarn passing through a second position on the traveler;

FIG. 12 is another view similar to FIG. 10 showing the same traveler continuing in use after the second position has become undesirably worn, and with the traveler repositioned on the ring and with the yarn passing through a third position on the traveler;

FIG. 13 is a side view of a fourth embodiment of the invention;

FIG. 14 is a rear view of the traveler shown in FIG. 13;

FIG. 15 is an environmental view similar to FIG. 1, but illustrating the traveler of FIG. 13 with yarn passing through a first position on the traveler;

FIG. 16 is a view similar to FIG. 15 showing the same traveler continuing in use after the first position has become undesirably worn, and with the yarn passing through a second position on the traveler; and FIG. 17 is another view similar to FIG. 15 showing the same traveler continuing in use after the second position has become undesirably worn, and with the traveler repositioned on the ring and with the yarn passing through a third position on the traveler.

DETAILED DESCRIPTION OF THE INVENTION

Referring more specificially to the drawings, a bobbin 10 is mounted for rotation with a spindle 11 and within a vertically reciprocable ring rail 12. A guide or spinning ring 13 is mounted in the ring rail 12 is surrounding relation to the bobbin 10. The guide ring 13 has upper and lower flanges 14 and 15 and a web 18. Yarn 16 extends through an eyelet 17 above the bobbin 10 through an ear-shaped traveler 20, mounted on the ring 13, to the bobbin 10.

The traveler 20 includes a shank 21 extending between rounded ends 22 and 23 terminating in respective horns 24, 25 extending inwardly toward each other and about the flanges 14 and 15 of the ring 13. The traveler 20 slides rapidly around the ring as the bobbin 10 rotates with the spindle 11 to wind the yarn 16 on the bobbin.

The friction generated by the traveler moving along the stationary ring causes the surface of the traveler to become worn after usage, but the amount of friction and consequently the amount of wear, is reduced by initially positioning the yarn of the traveler so that the yarn tension equalizes the pressure of the horns 24 and 25 against respective flanges 14, 15 on the ring 13.

Generally speaking, a traveler's function is to change the vertical direction of an incoming yarn to a horizontal direction as the yarn approaches the bobbin, and to impose on the yarn a certain tension. The amount of tension is important and varies from yarn to yarn, but in all cases it is critical that the tension be uniform. The friction of the traveler on the ring and the friction of the yarn on the traveler changes, causing a change in tension, when the traveler becomes worn and engages the ring at a different attitude, as when the traveler edges or assumes an inclined position relative to the ring. This occurs because different forces act on the traveler as the traveler slides around the ring at high speeds. These are the forces resulting from the tension of the yarn, both horizontally inwardly toward the bobbin at the center of the ring and vertically upwardly from the ring toward the source of the yarn. Additionally, the rapid movement of the traveler around the ring subjects it to centrifugal forces urging the traveler radially outwardly of the ring. Consequently, the traveler has predetermined zones facing the ring which are subject to increased loads and hence, to greater wear. The traveler of this invention equalizes the pressure on the zones of the traveler subject to wear and enables a traveler to be reused by repositioning the traveler and/or the yarn after first zones of wear have undesirably changed the yarn tension, thereby prolonging the useful life of the traveler.

According to the invention, the traveler 20 is made of a synthetic material, nylon for example, and the embodiment of FIGS. 2 through 5 includes a first shoulder 30 merging as at 31 with the back or outer surface 32 of the shank 21. The shoulder 30 curves outwardly and upwardly in FIG. 2 and terminates in a finger portion 33 spaced from the back surface 32 of the shank 21. The shoulder 30 and its finger 33 define a yarn passageway 34 and the space 35 between the finger 33 and shank 21 provides access to the passageway 34 through which a medial portion P of yarn 16 may be readily passed.

A second shoulder 36 merges as at 37 with the back or rear surface 32 of shank 21 and curves outwardly and downwardly therefrom, terminating in a finger portion 38 spaced from the rear surface 32. The shoulder 36 and its finger 38 define a second yarn passageway 40 concentric with the yarn passageway 34. A space 41 between the finger 38 and the back surface 32 provides access to the passageway 40 and a space 42 between the shoulders 30 and 36 (FIGS. 4 and 5) permits free passage of a medial portion P of yarn 16 to the passageway 40 or 34, as desired.

Referring to FIG. 1, the traveler 20 is mounted on the ring 13 with the finger 38 of shoulder 36 pointing downwardly and with the yarn 16 positioned in the passageway 40 between finger 38 and shank 21 of the traveler. The tension on the yarn and the speed of the traveler creates friction between the yarn and the zone of the traveler near the merge line 37 of shoulder 36 so that this zone of the traveler is subjected to wear during use. The yarn passageway 40 located midway between the free ends of the horns 24, 25 tends to equalize the horizontal forces causing frictional resistance between the ring and the wear zones on the horns 24, 25, but the vertical forces on the yarn pulls the bottom portion and horn 25 of the traveler 20 against the bottom flange 15, causing more wear on that zone than is experienced at the top of the traveler.

When these zones of the traveler become sufficiently worn to affect the tension on the yarn, the traveler need not be replaced, as has been the practice, but it can continue in use by removing the yarn from the passageway 40 through the spaces 41 and 42 and repositioning the traveler 20 on the ring with the finger 33 of shoulder 30 pointing downwardly and with the relatively unworn horn 24 extending about the lower flange 15 as in FIG. 1A. The yarn 16 is then repositioned in passageway 34 by passing a medial portion P through the spaces 35 and 42. Operation is then resumed with new wear zones of the traveler 20 engaging the ring and the yarn, and the life of the traveler is thereby increased.

A modified form of the invention is illustrated in FIGS. 6 and 7 wherein like parts of the traveler are represented by the same reference number as heretofor used and the different parts bear the same reference number with the prime notation added. The traveler $20^1$ of FIGS. 6 and 7 differs from the embodiment illustrated in FIGS. 1 through 5 in that the fingers $33^1$ and $38^1$ of respective shoulders $30^1$, $36^1$ on traveler $20^1$ extend laterally beyond the sides of the traveler to provide spaces $35^1$ and $41^1$ which facilitate positioning of a medial portion P of the yarn 16 in the passageways 34 and 40 defined by the shoulders and fingers. The traveler $20^1$ of FIGS. 6 and 7 is positioned on the ring and may be repositioned on the ring 13 in the same manner as previously described in connection with the traveler of FIGS. 1 through 5.

FIGS. 8 through 12 illustrate a further embodiment of the traveler, broadly indicated at 50. The traveler 50 includes a shank 51 extending between squared ends 52 and 53 terminating in respective horns 54 and 55 extending inwardly toward each other. A shoulder 56 projects from the rear wall 57 of spline 51. A finger 58 curves downwardly and inwardly from the rear portion 59 of shoulder 56, terminating in a free end 60 in closely spaced relation to an abutment 61 extending rearwardly from the back wall 57 of spline 51. The finger 58 and shoulder 59 cooperate with the back wall 57 to define a yarn passageway 62 with the space 63 between the free end 60 of finger 58 and the abutment 61 providing a restricted access for a medial portion P of yarn 16 into the passageway 62.

FIGS. 9, 10 and 11 illustrate an initial position and successively different positions of the yarn 16 on the traveler 50 as the same traveler is reused to guide yarn 16 onto the rotating bobbin 10 after preceding wear zones on the traveler have deteriorated, jeopardizing the uniformity of the tension.

In FIG. 9, the traveler is mounted on the ring 13 in an initial position with the squared end 52 and its horn 54 extending about the upper flange 14 and the squared end 53 and its horn 55 extending about the lower flange 15 of the ring 13. A medial portion P of the yarn 16 has been moved through the space 63 between finger 58 and abutment 61 into the passageway 62. So positioned, the horizontal forces of the tensioned yarn 16 tend to equalize the pressure on the horns 54, 55 against their respective flanges 14 and 15 sufficiently that those wear zones out last the wear zone at the passageway 62 where the yarn rubs against the traveler. The traveler 50 can continue to be used after the wear zone at passageway 62 jeopardizes the uniformity of tension by removing the yarn from the passageway 62 and repositioning the yarn 16 over the horn 54 in engagement with the zone 63 at the upper inner surface of traveler 50 adjacent the juncture of spline 57 with squared end 52 (FIG. 11).

The traveler 50 may be used a third time after the yarn 16 undesirably wears away the zone 63 by repositioning the traveler 50 and the ring 13 so the squared end 53 and its horn 55 extend about the upper flange 14 and the squared end 52 and its horn 54 extend about the lower flange 15 of ring 13 (FIG. 12). The yarn 16 is then passed over horn 55 and into engagement with zone 64 at the inner surface of traveler 50 adjacent the juncture of spline 57 and squared end 53 in FIG. 12. When the zone 64 at squared end 53 becomes undesirably worn, the traveler 50 must be discarded and replaced with a new traveler. The traveler 50 will have, however, lasted longer than the prior art travelers and will have contributed to increased production because of the relative ease of positioning and repositioning the yarn in the passageway 62 and zones 63 and 64.

A further embodiment of the traveler is generally indicated at 70 in FIGS. 12 through 16. Traveler 70 has rounded ends 71 and 72 terminating in respective horns 73 and 74. The rounded end portions 71 and 72 are connected by a spline 75 formed integral therewith and projecting forwardly at 75A and 75B toward the horns 73, 74 from the juncture of the spline 75 with the rounded end portions 71 and 72 (FIG. 13). The inwardly projecting spline 75 is positioned between the flanges 14 and 15 on the ring 13 and in closely spaced relation to or against the web 18 of ring 13. The inner configuration of the spline 75 and the circles 77 and 78 defined by the rounded end portions 71 and 72 generally conform to the cross-sectional configuration of the ring 13 and the proximity of the spline 75 to the web 18 of the ring results in the spline 75 engaging the web as the traveler slides along the ring, thereby stablizing the traveler and limiting the frictional wear at the zones of the horns 73 and 74.

The traveler 70 is specifically designed to be used and re-used with the yarn positioned to engage the traveler at different positions. A finger 79 extending downwardly from the rounded end portion 71 in rearwardly spaced relation to the spline 75 and terminating at 80 in spaced relation to the rounded end portion 72 defines a yarn passageway 81 (FIG. 13). The upper end 82 of the yarn passageway 81 is in the medial portion of the traveler 70 between its horns 73 and 74.

It is intended that the first use of the traveler be with the yarn 16 positioned in the passageway 81 and engaging the traveler at the inner end 82 of the passageway (FIG. 15). As in the previously described forms of the invention, the medial location of the passageway 81 equalizes the pressure on the horns and minimizes excessive frictional wear of one horn over the other. Eventually, however, the friction of the yarn traversing the passageway 81 will undesirably wear that zone of the traveler adjacent the inner end 82 of the passageway. When this happens, the yarn is removed from the passageway 81 moving a medial part of the yarn past the free end 80 of finger 79 and repositioning the yarn on the traveler by drawing a medial portion of the yarn past the horn 73 to engage the zone 83 on the inner surface of the rounded end portion 71 adjacent the spline portion 75A (FIG. 16). In due course, the friction of the yarn moving against the zone 83 will undesirably wear the zone 83 for effective use and at that time the yarn 16 may be repositioned to engage zone 84 on the inner surface of the traveler adjacent the juncture of spline portion 75B and end portion 72, after the traveler has been repositioned on the ring 13 as shown in FIG. 17.

The engagement of the bulbous spline 75 with the web 13 of the ring is effective in the positions of FIGS. 16 and 17 to stablize the traveler and equalize the wear on the zones adjacent horns 73 and 74, and contributes to those zones continuing to be productive as the yarn is positioned in successively usable zones 82, 83 and 84.

There is thus provided an improved traveler which is structured to equalize the wear on the parts of the traveler engaging a ring and which is structured to receive the yarn in different operative positions or zones on the traveler to prolong the useful life of the traveler.

Although specific terms have been used in descriping the invention, they are used in a descriptive and generic sense only and not for purposes of limitation.

I claim:

1. A traveler for use with a ring for winding yarn on a bobbin, said traveler comprising end portions with hooks slidably mounted on the ring, a spline formed integral with the end portions and extending therebetween, a first shoulder projecting from the rear surface of the spline and away from the hooks and having a first transverse passageway therethrough, the passageway being between the hooks, an access opening providing communication between the passageway and the atmosphere adjacent one end portion, a second shoulder extending from the rear surface of the spline and having a second passageway therethrough concentric with the passageway in the first shoulder, the said first and second shoulders being spaced from each other, and an access opening providing communication between the second passageway and the atmosphere adjacent the opposite end portion, whereby the medial portion of a yarn may be readily positioned in a selected passageway.

2. A structure according to claim 1 wherein each shoulder includes a finger defining a portion of the passageway through each shoulder and each finger projecting laterally beyond one side of the traveler to facilitate positioning of a medial portion of yarn within each passageway.

3. A traveler for use with a ring for winding yarn on a bobbin, said traveler comprising end portions with hooks slidably mounted on the ring, a spline formed integral with the end portions and extending therebetween, at least one shoulder projecting from the rear surface of the spline and away from the hooks and having a passageway therethrough, the passageway being between the hooks, an access opening providing communication between the passageway and the atmosphere adjacent one end portion, said shoulder including a finger terminating in spaced relation to the back of the spline and defining a portion of the passageway, and an abutment projecting rearwardly from the spline adjacent the free end of the finger to define a restricted access for a medial portion of yarn to the passageway.

* * * * *